US006650341B2

(12) United States Patent
Kato

(10) Patent No.: US 6,650,341 B2
(45) Date of Patent: Nov. 18, 2003

(54) LIQUID CRYSTAL DRIVING METHOD AND LIQUID CRYSTAL DRIVING CIRCUIT FOR CORRECTING

(75) Inventor: Fumihiko Kato, Yamagata (JP)

(73) Assignee: NEC Electronics Corporation, Kanagawa (JP)

( * ) Notice: Subject to any disclaimer, the term of this patent is extended or adjusted under 35 U.S.C. 154(b) by 36 days.

(21) Appl. No.: 09/741,937

(22) Filed: Dec. 20, 2000

(65) Prior Publication Data

US 2002/0033788 A1 Mar. 21, 2002

(30) Foreign Application Priority Data

Dec. 20, 1999 (JP) ..... 11-360239

(51) Int. Cl.[7] ..... G09G 5/10
(52) U.S. Cl. ..... 345/690; 345/88; 345/213
(58) Field of Search ..... 345/87–103, 204–214

(56) References Cited

U.S. PATENT DOCUMENTS 5,625,373 A * 4/1997 Johnson ..... 345/100
6,140,989 A 10/2000 Kato ..... 345/89
6,160,534 A * 12/2000 Katakura ..... 345/100
6,281,871 B1 * 8/2001 Nohara ..... 345/100
6,342,881 B1 * 1/2002 Inoue ..... 345/204

FOREIGN PATENT DOCUMENTS

JP 9-218671 8/1997

* cited by examiner

*Primary Examiner*—Amr Awad
(74) *Attorney, Agent, or Firm*—Choate, Hall & Stewart

(57) ABSTRACT

A liquid crystal drive circuit for AC-driving a liquid crystal panel, the liquid crystal drive circuit being constituted of a switched capacitor type D/A converter having a sample period and a hold period, the liquid crystal drive circuit comprising a differential operational amplifier 204, a first reference voltage input terminal 200 connected to one input terminal of the differential operational amplifier, a first capacitor group 205 connected to the other input terminal of the differential operational amplifier, for dividing second and third reference voltages 201 and 202, a second capacitor group 206 connected between an output terminal and the other input terminal of the differential operational amplifier, and switch means 207 to 218 for changing a connection condition of the first capacitor group and the second capacitor group to the differential operational amplifier, the switch means being on-off controlled at every predetermined periods for changing the connection condition, so that a color unevenness is minimized when the liquid crystal panel is displayed. In a liquid crystal drive circuit for generating a drive voltage for a graduation display realized by applying a predetermined voltage to a liquid crystal panel, an output voltage error appearing at the time of an AC drive can be compensated in units of frames.

5 Claims, 7 Drawing Sheets

PRIOR ART

PRIOR ART

LIQUID CRYSTAL DRIVING METHOD AND LIQUID CRYSTAL DRIVING CIRCUIT FOR CORRECTING

BACKGROUND OF THE INVENTION

The present invention relates to a liquid crystal driving method and a liquid crystal driving circuit, and more specifically to a liquid crystal driving method and a liquid crystal driving circuit, which can control unevenness in color in a liquid crystal panel, attributable to a voltage shift occurring in the case of carrying out an AC driving on the basis of a potential on an opposing electrode in the liquid crystal panel.

In general, a liquid crystal panel is written with several tens frames (several tens screen images) per second, and an output signal of a liquid crystal drive circuit carries out an AC drive on the basis of a potential on an opposing electrode in the liquid crystal panel, in units of scan line or in units of frame. Namely, if an DC voltage continues to be applied to the liquid crystal, ions are accumulated in one electrode, with the result that the liquid crystal becomes immediately deteriorated. In order to avoid this deterioration, the AC drive is carried out by inverting, in units of one frame or a few frames, the positive/negative polarity of the liquid crystal drive circuit output signal, which is a video signal voltage to be applied to the liquid crystal.

FIG. 7 shows an example of the liquid crystal drive circuit for carrying out the AC drive on the basis of the potential on the opposing electrode in the liquid crystal panel in the above mentioned manner. This liquid crystal drive circuit is a technology disclosed in Japanese Patent Application Pre-examination Publication No. JP-A-09-218671, and is a switched capacitor type D/A converter having a sample period and a hold period. This D/A converter is mainly constituted of a differential operational amplifier 304 connected to an output terminal 303 and having a non-inverted input terminal connected to a first reference voltage input terminal 300. An inverted input terminal of the differential operational amplifier 304 is connected to a first capacitor group 305 including a plurality of capacitors which are constituted of unitary capacitors as a basic element. A second capacitor or a second capacitor group (which will be expediently generically called the second capacitor group in this description) 306 is connected between the non-inverted input terminal and the output terminal 303 of the differential operational amplifier 304. In addition, the following switch group is constituted for on-off switching between the differential operational amplifier 304, the first capacitor group 305 and the second capacitor group 306.

Namely, a first switch group 307 is provided in which one end of each switch is connected to one end of a corresponding capacitor in the first capacitor group 305 and the other end of each switch is connected in common to a second reference voltage input terminal 301. A second switch group 308 is provided in which one end of each switch is connected to one end of a corresponding capacitor in the first capacitor group 305 and the other end of each switch is connected in common to a connection node between third and fourth switches 309 and 310 explained hereinafter. There are provided the third switch 309 having one end connected to the other end of the second switch group 308 and the other end connected to the first reference voltage input terminal 300 and the non-inverted input terminal of the differential operational amplifier 304, the fourth switch 301 having one end connected to the other end of the second switch group 308 and the one end of the third switch 309 and the other end connected to a third reference voltage input terminal 302, and a fifth switch 311 connected in parallel to the second capacitor group 306.

In this liquid crystal drive circuit, two values are selected from gamma-compensated analog gradation voltages of for example 8 to 10 gradation levels, which are supplied from an external circuit of the drive circuit, and the two selected values of the analog gradation voltages are supplied to the second and third reference voltage input terminals 301 and 302, respectively, and on the other hand, the first to fifth switch groups and switches 307 to 311 are selected turned on, so that an analog gradation voltage is further divided with the result that one level of multi-gradated gradation data is outputted from the output terminal 303 as an analog image data. In addition, the polarity of the voltages applied to the second and third reference voltage input terminals 301 and 302 is inverted in order to carry out the AC drive. Incidentally, the inversion of the polarity of the reference voltage generates a large load when the liquid crystal drive circuit is operated. Therefore, the above referred Japanese publication discloses that a control circuit is provided for selectively operating each of the above mentioned switches. This control circuit receives a digital image data, a sample/hold input clock and a frame input clock, and inverts the polarity of the voltage outputted from the output terminal, on the basis of the voltage on the first reference voltage input terminal 300, in accordance with the image data and the clocks. However, the detail will be omitted.

However, in the liquid crystal drive circuit shown in FIG. 7, since the output voltage is determined by a ratio between the first capacitor group 305 and the second capacitor group 306, if the value of this ratio varies, the output voltage is deviated from a set value. For example, in the process of a fabrication of the liquid crystal drive circuit, when a reticle is prepared or when a capacitor is actually shot onto a wafer, if a difference occurs in capacitance between the first capacitor group 305 and the second capacitor group 306, by changing from one circuit to another, from one chip to another, from one wafer to another, and from one lot to another, an error occurs in the output voltage as mentioned above, with the result that a display unevenness attributable to the output voltage difference occurs in an image displayed in the liquid crystal.

This output voltage difference can be specifically expressed by the following mathematical equations. Here, in order to simplify the calculation, it is assumed that the circuit shown in FIG. 7 is a 2-bit switched capacitor type D/A converter. When the value of the first capacitor group 305 is deviated from the value of the second capacitor group 306 by a capacitance value $\Delta\alpha$ in a capacitance increasing direction, the voltage value of a positive side is expressed by the equation (1):

$$Vout(\text{positive}, \alpha)=\{Vref(4+\Delta\alpha)\}/(4+\Delta\alpha)-4V_2/(4+\Delta\alpha)-\{\chi(V_1+V_2)\}/(4+\Delta\alpha) \quad (1)$$

In a similar condition, the voltage value of a negative side is expressed by the equation (2):

$$Vout(\text{negative}, \alpha)=\Delta\alpha/(4+\Delta\alpha)+4V_2/(4+\Delta\alpha)+\{\chi(V_1+V_2)\}/(4+\Delta\alpha) \quad (2)$$

where Vref is a first reference voltage supplied to the first reference voltage input terminal 300, $V_1$ is a second reference voltage supplied to the second reference voltage input terminal 301, and $V_2$ is a third reference voltage supplied to the third reference voltage input terminal 302.

In the case of driving the liquid crystal panel, the AC drive is carried out by alternately outputting the voltage expressed by the equation (1) and the voltage expressed by the equation (2). However, if the capacitance value difference expressed by $\Delta\alpha$ occurs in each of the above equations, the amplitude of the voltage on the basis of the potential of the opposing electrode in the liquid crystal panel increases as shown in FIG. 8, or alternatively decreases, so that the output signal having an error is outputted. Therefore, an actually displayed color is expressed as an effective value=[(1)−(2)]/2. This effective value is expressed by the equation (3). Incidentally, the equation (3) is expressed in the form of $A(\Delta\alpha)$ which is a function of $\Delta\alpha$.

$$Vout(\alpha)=4Vref/(4+\Delta\alpha)-4V_2/(4+\Delta\alpha)-\{\chi(V_1+V_2)\}/(4+\Delta\alpha) \quad (3)$$

Next, when the value of the second capacitor group 306 is deviated from the value of the first capacitor group 305 by a capacitance value $\Delta\beta$ in a capacitance increasing direction, the voltage value of a positive side and the voltage value of a negative side are expressed by the equations (4) and (5), respectively:

$$Vout(\text{positive}, \beta)=\{Vref(8+\Delta\beta)\}/4-V_2-\{\chi(V_1-V_2)\}/4-(V_1\cdot\Delta\beta)/4 \quad (4)$$

$$Vout(\text{negative}, \beta)=-\{Vref\cdot\Delta\beta)\}/4+V_2+\{\chi(V_1-V_2)\}/4-(V_1\cdot\Delta\beta)/4 \quad (5)$$

Thus, an actually displayed color is expressed as an effective value=[(4)−(5)]/2. This effective value is expressed by the equation (6). Incidentally, the equation (6) is expressed in the form of $B(\Delta\beta)$ which is a function of $\Delta\beta$.

$$Vout(\beta)=\{Vref(4+\Delta\beta)\}/4-V_2-\{\chi(V_1-V_2)\}/4-(V_1\cdot\Delta\beta)/4/ \quad (6)$$

Accordingly, a difference in the output between the equation (3) and the equation (6) is observed as a color unevenness between circuit outputs, between chips, between wafers, and between lots. If the degree of this color unevenness is expressed by a output voltage difference $\Delta V$, the following equation (7) is obtained:

$$\Delta V=A(\Delta\alpha)-B(\Delta\beta) \quad (7)$$

BRIEF SUMMARY OF THE INVENTION

Accordingly, it is an object of the present invention to provide a liquid crystal driving method and a liquid crystal driving circuit, which can cancel the above mentioned color unevenness attributable to the deviation of the capacitance in the capacitor groups.

A liquid crystal drive method in accordance with the present invention is characterized in that in a liquid crystal drive method for carrying out a gradation display by AC-driving a liquid crystal panel by use of a liquid crystal drive circuit constituted of a switched capacitor type D/A converter, the liquid crystal panel is driven by alternately changing, at every predetermined periods, the polarity of an output error appearing in the liquid crystal drive circuit. Here, the polarity of the output error is alternately changed in units of "n" frames (where "n" is integer not less than 1).

In addition, a liquid crystal drive circuit in accordance with the present invention is constituted of a switched capacitor type D/A converter having a sample period and a hold period, for AC-driving a liquid crystal panel, the liquid crystal drive circuit comprising a differential operational amplifier, a first reference voltage connected to one input terminal of the differential operational amplifier, a first capacitor group connected to the other input terminal of the differential operational amplifier, for dividing second and third reference voltages, a second capacitor group connected between an output terminal and the other input terminal of the differential operational amplifier, and switch means for changing a connection condition of the first capacitor group and the second capacitor group to the differential operational amplifier, the switch means being on-off controlled at every predetermined periods for changing the connection condition.

As shown in a conception diagram of FIG. 1, the liquid crystal drive circuit in accordance with the present invention is constituted of a switched capacitor type D/A converter having a sample period and a hold period, which comprises a differential operational amplifier 104, a first reference voltage input terminal 100 connected to a non-inverted input terminal of the differential operational amplifier 104, a first capacitor group 105 connected to an inverted input terminal of the differential operational amplifier 104 for dividing a reference voltage supplied from second and third reference voltage input terminals 101 and 102, a second capacitor group 106 connected between an output terminal 103 and the inverted input terminal of the differential operational amplifier 104, and a switching means 107 for changing a connection condition of the first capacitor group 105 and the second capacitor group 106 to the differential operational amplifier 104, so that by on-off controlling the switching means 107 at every predetermined periods, the connection condition is changed. Therefore, when there is an error or a variation in the capacitance value between the first capacitor group 105 and the second capacitor group 106 in the liquid crystal drive circuit so that an output error occurs which causes a color unevenness, the connection condition of the first capacitor group 105 and the second capacitor group 106 is exchanged by the switching means 107 at every "n" frames for example, so that the polarity of the appearing output error is inverted at every "n" frames, with the result that the appearing output error is canceled at every "2n" frames and therefore the color unevenness is canceled.

EMBODIMENTS

Figure 1:
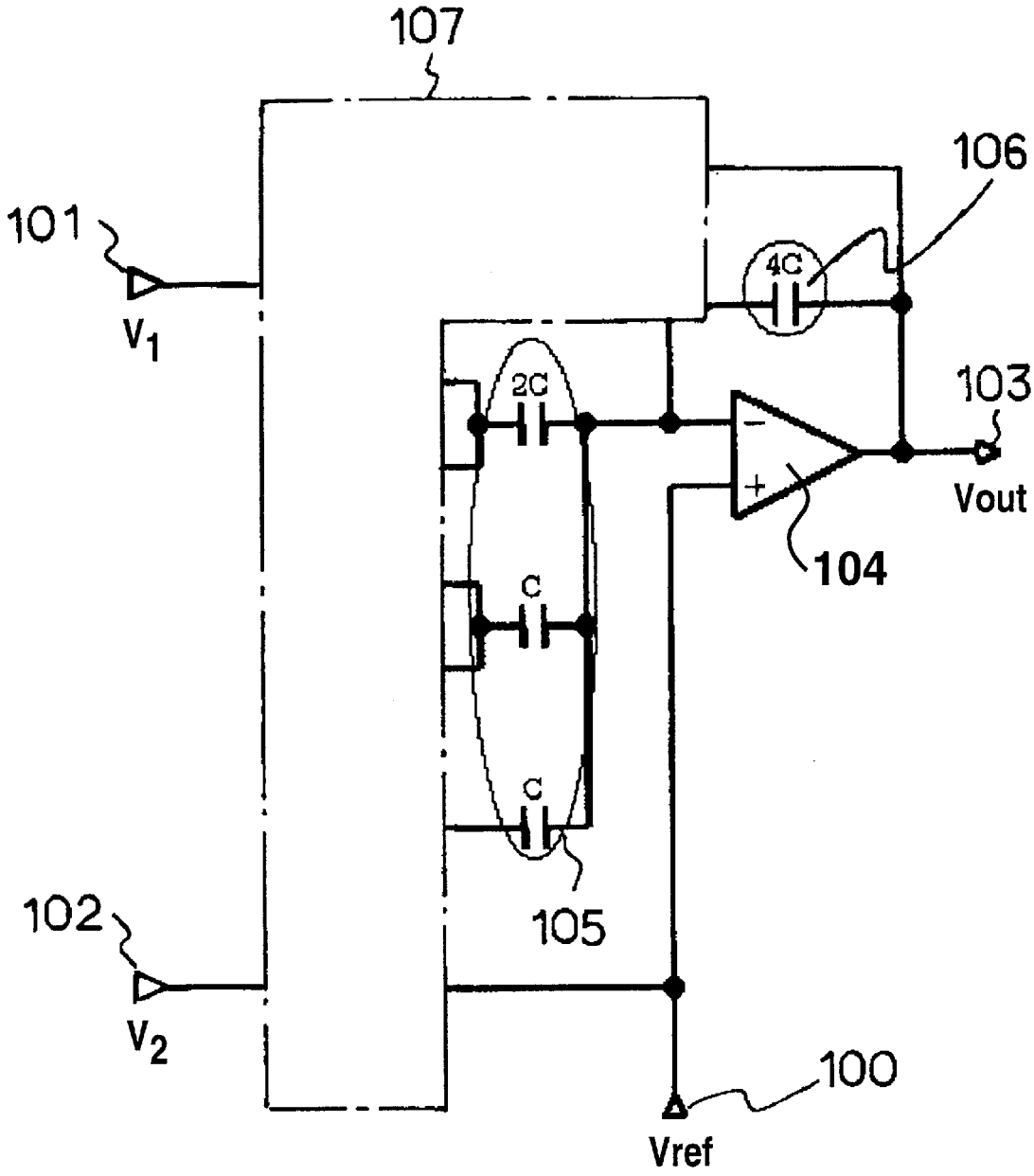
FIG. 1 is a circuit diagram illustrating a conceptual construction of the liquid crystal drive circuit in accordance with the present invention.
Figure 2:
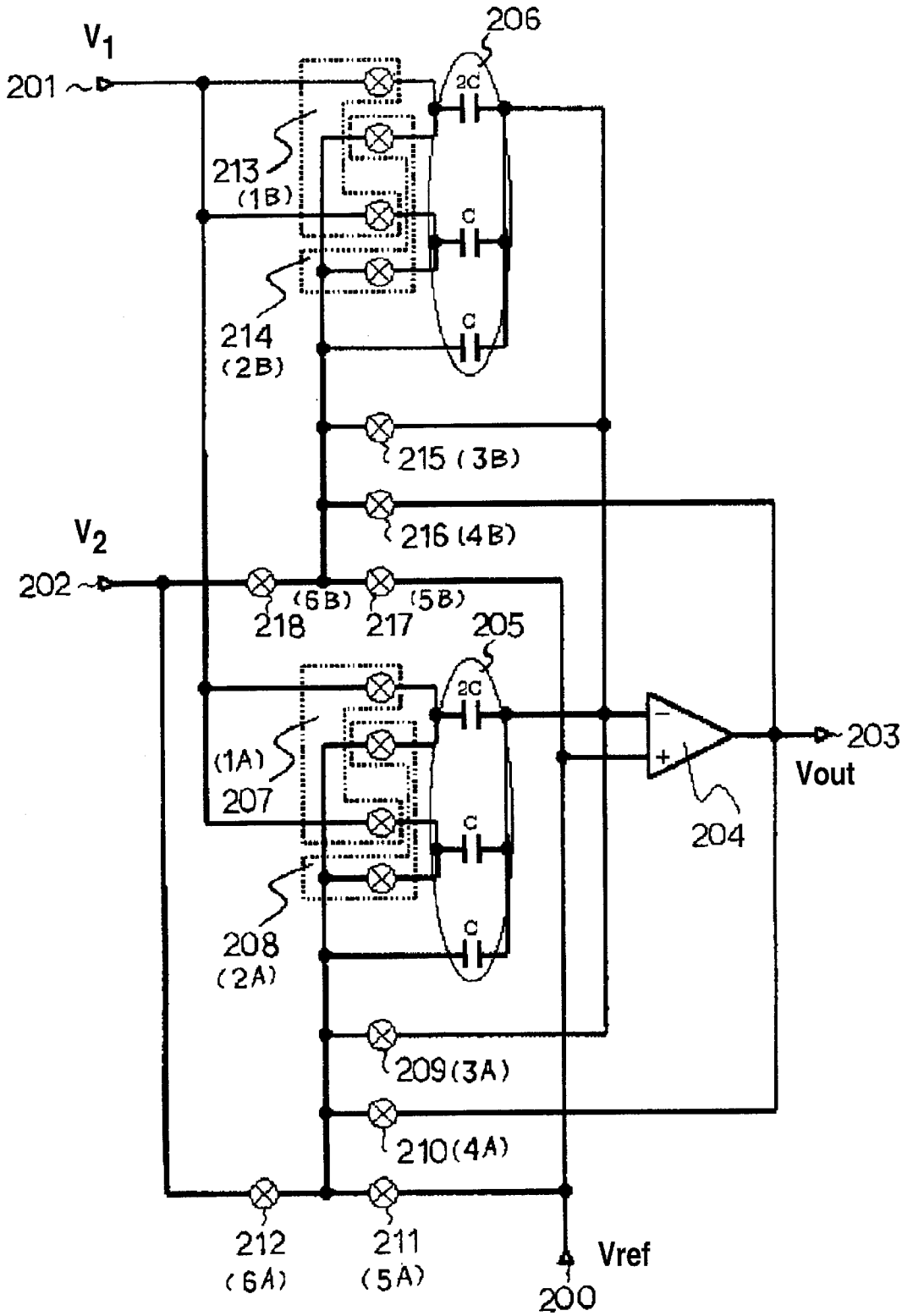
FIG. 2 is a circuit diagram illustrating one embodiment of the liquid crystal drive circuit in accordance with the present invention.

Now, one embodiment of the liquid crystal drive circuit in accordance with the present invention will be described with reference to the drawings. FIG. 2 is a circuit diagram of an embodiment in which the present invention is applied to a liquid crystal drive circuit composed of a 2-bit switched capacitor type D/A converter having a sample period and a hold period. This is mainly constituted of a differential operational amplifier 204 connected to an output terminal 203 and having a non-inverted input terminal connected to a first reference voltage input terminal 200. This further includes a first capacitor group 205 connected to an inverted input terminal of the differential operational amplifier 204 and constituted of a plurality of unitary capacitors as a basic element, and a second capacitor group 206 connected to the inverted input terminal of the differential operational amplifier 204 and constituted of a plurality of unitary capacitors as a basic element. Furthermore, switch groups and switches are provided for changing the connection of a second reference voltage input terminal 201 and a third reference voltage input terminal 202 to the differential operational amplifier 204 and the first and second capacitor groups 205 and 206.

Specifically, there are provided a "1A"th switch group 207 having switches each having one end connected to a corresponding capacitor in the first capacitor group 205 and the other end connected to the reference voltage input terminal 201, a "2A"th switch group 208 having switches each having one end connected to a corresponding capacitor in the first capacitor group 205, a "3A"th switch 209 having one end connected to the other end of the "2A"th switch group 208 and the other end connected to the inverted input terminal of the differential operational amplifier 204, a "4A"th switch 210 having one end connected to the other end of the "2A"th switch group 208 and the one end of the "3A"th switch 209 and the other end connected to the output terminal 203 of the differential operational amplifier 204, a "5A"th switch 211 having one end connected to the other end of the "2A"th switch group 208, the one end of the "3A"th switch 209 and the one end of the "4A"th switch 210 and the other end connected to the first reference voltage input terminal 200 and the non-inverted input terminal of the differential operational amplifier 204, and a "6A"th switch 212 having one end connected to the other end of the "2A"th switch group 208 and the respective one ends of the "3A"th switch 209, the "4A"th switch 210 and the "5A"th switch 211 and the other end connected to the third reference voltage input terminal 202.

Furthermore, there are provided a "1B"th switch group 213 having switches each having one end connected to a corresponding capacitor in the second capacitor group 206 and the other end connected to the second reference voltage input terminal 201, a "2B"th switch group 214 having switches each having one end connected to a corresponding capacitor in the second capacitor group 206, a "3B"th switch 215 having one end connected to the other end of the "2B"th switch group 214 and the other end connected to the inverted input terminal of the differential operational amplifier 204, a "4B"th switch 216 having one end connected to the other end of the "2B"th switch group 214 and the one end of the "3B"th switch 215 and the other end connected to the output terminal 203 of the differential operational amplifier 204, a "5B"th switch 217 having one end connected to the other end of the "2B"th switch group 214, the one end of the "3B"th switch 215 and the one end of the "4B"th switch 216 and the other end connected to the first reference voltage input terminal 200 and the non-inverted input terminal of the differential operational amplifier 204, and a "6B"th switch 218 having one end connected to the other end of the "2B"th switch group 214 and the respective one ends of the "3B"th switch 215, the "4B"th switch 216 and the "5B"th switch 217 and the other end connected to the third reference voltage input terminal 202.

Figure 3:
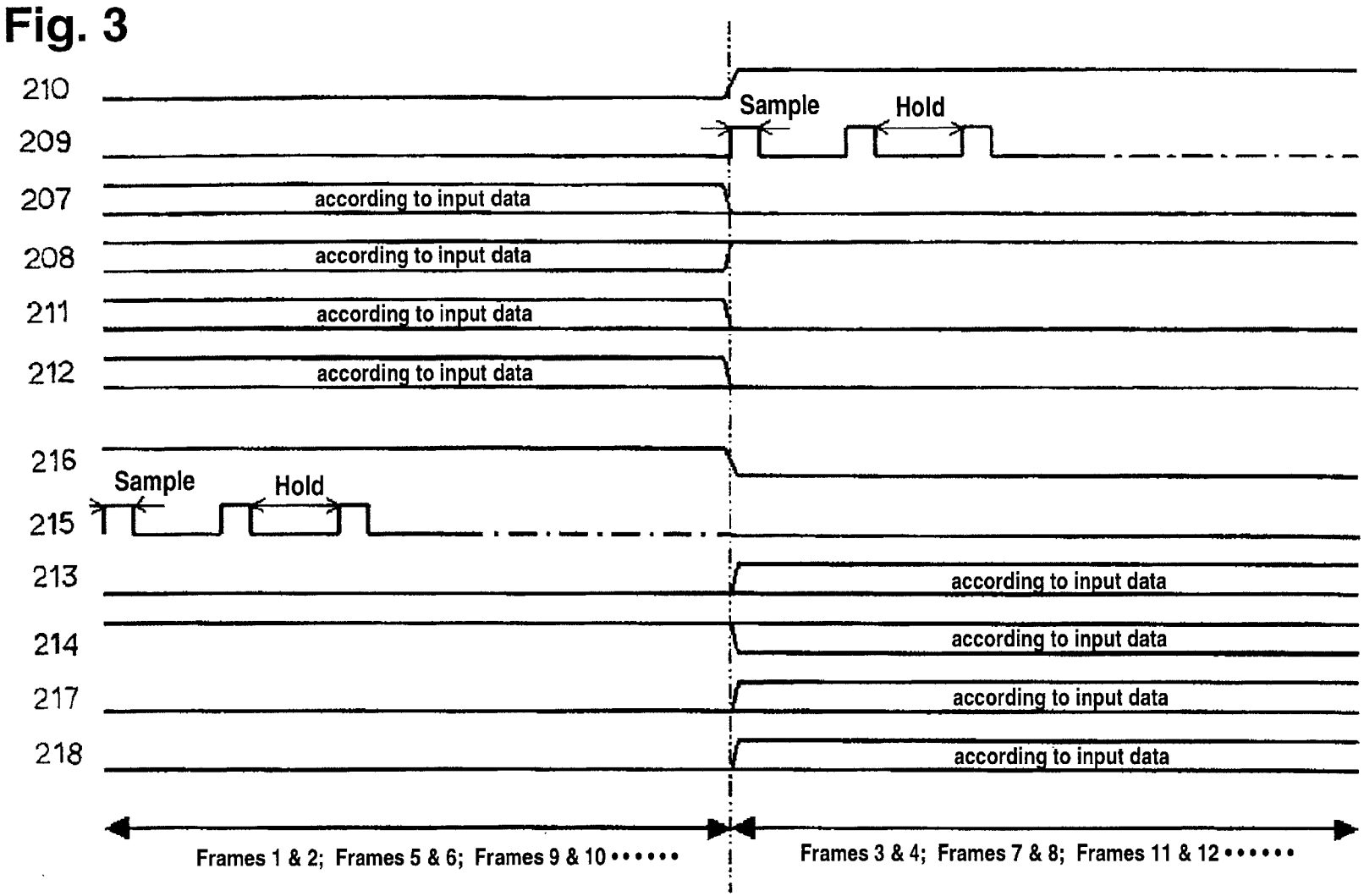
FIG. 3 is a timing chart illustrating a driving method for the liquid crystal drive circuit shown in FIG. 2.
Figure 4:
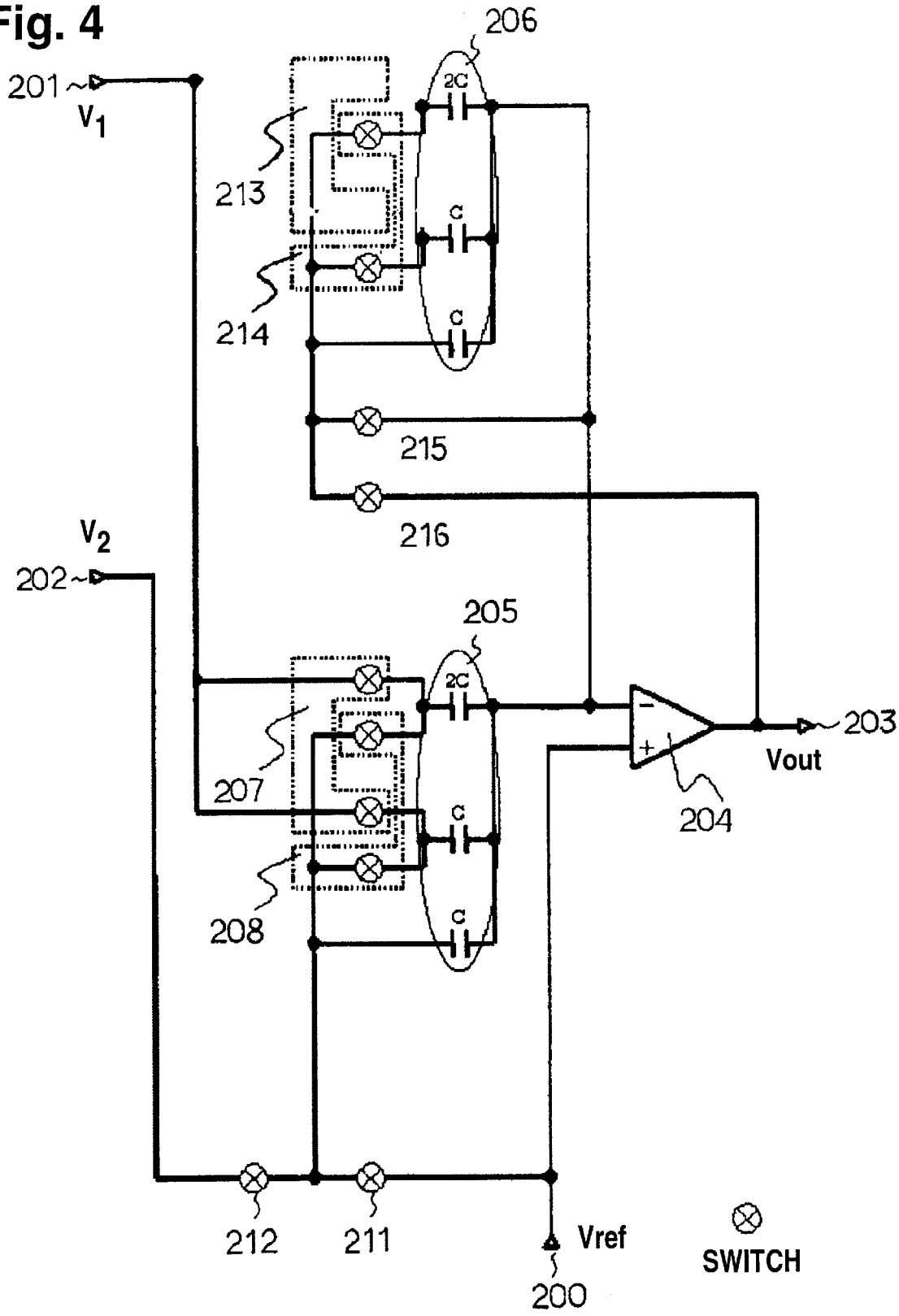
FIG. 4 is a circuit diagram showing a connection condition in a switch operation for first and second frames.

The "1A"th to "6A"th switch groups and switches, and the "1B"th to "6B"th switch groups and switches are so configured to be complementarily turned on and off in units of frame(s). In this embodiment, they are so configured to be alternately turned on and off in units of two frames. Namely, FIG. 3 is a timing chart illustrating the on-off operations of those switch groups and switches. In the operation of those switch groups and switches, a high level indicates an ON condition, Now, a liquid crystal driving method for the liquid crystal driving circuit having the above mentioned construction will be described with reference to FIG. 2 to FIG. 5. In FIG. 2 and FIG. 3, the "4A"th switch 210 and the "4B"th switch 216 function to alternately replace one of the first capacitor group 205 and the second capacitor group 206 by the other and vice versa at every two frames. Namely, as in first and second frames, fifth and sixth frames, etc., when the "4A"th switch 210 is OFF, the "4B"th switch 216 is ON, and furthermore, all of the "1B"th switch group 213, the "3A"th switch 209 and the "5B"th switch 217 and the "6B"th switch 218 are maintained in an OFF condition, and at the same time, the "2B"th switch group 214 is maintained in an ON condition. In addition, the "1A"th switch group 207, the "2A"th switch group 208, the "5A"th switch 211, the "6A"th switch 212 and the "3B"th switch 215 are on-off switched in accordance with an input data. The circuit excluding the switch groups and switches maintained in the OFF condition in this situation and their associated interconnections, is shown in FIG. 4.

Figure 5:
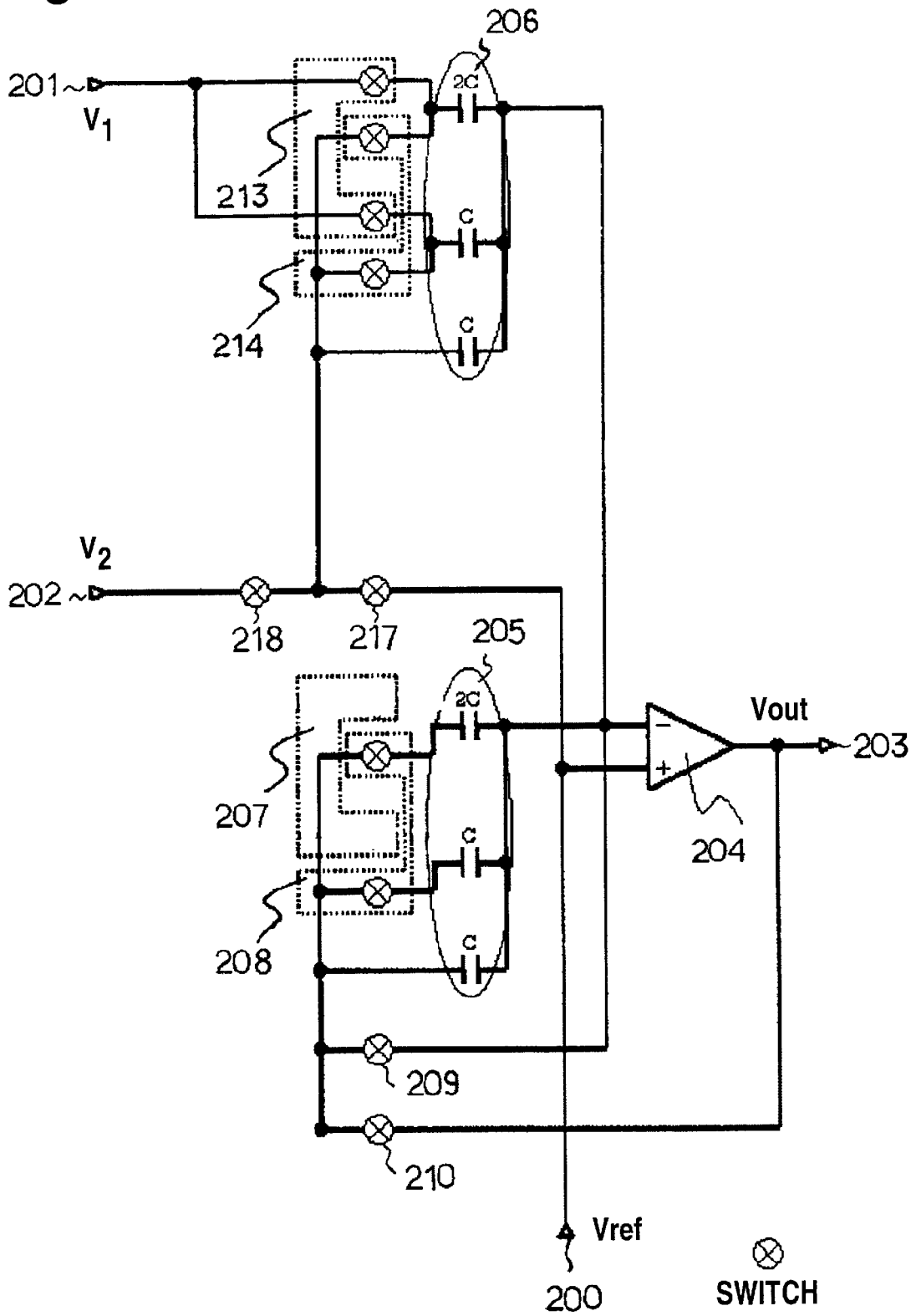
FIG. 5 is a circuit diagram showing a connection condition in a switch operation for third and fourth frames.

On the other hand, as in third and fourth frames, seventh and eighth frames, etc., when the "4B"th switch 216 is OFF, the "4A"th switch 210 is ON, and furthermore, all of the "1A"th switch group 207, the "3B"th switch 215 and the "5A"th switch 21A and the "6A"th switch 212 are maintained in an OFF condition, and at the same time, the "2A"th switch group 208 is maintained in an ON condition. In addition, the "1B"th switch group 213, the "2B"th switch group 214, the "5B"th switch 217, the "6B"th switch 218 and the switch 209 are on-off switched in accordance with the input data. The circuit excluding the switch groups and switches maintained in the OFF condition in this situation and their associated interconnections, is shown in FIG. 5.

Accordingly, this liquid crystal drive circuit is so constructed that, as in the first, second, fifth and sixth frames and in the third, fourth, seventh and eighth frames, the connection condition of the first capacitor group 205 to the differential operational amplifier 204 and the connection condition of the first capacitor group 205 to the differential operational amplifier 204 are replaced by each other in units of two frames, so that an operation output is obtained in the connection condition thus replaced. Here, when the value of the first capacitor group 205 is deviated from the value of the second capacitor group 206 by a capacitance value $\Delta\alpha$ in a capacitance increasing direction, the voltage value of a positive side and the voltage value of a negative side are expressed by the equations (8) to (11) for the first and second frames and the third and fourth frames, respectively:

$$Vout(\text{positive}, \alpha, 1, 2)=\{Vref(8+\Delta\alpha)\}/(4+\Delta\alpha)-4V_2/(4+\Delta\alpha)-\{\chi(V_1-V_2)\}/(4+\Delta\alpha) \quad (8)$$

$$Vout(\text{negative}, \alpha, 1, 2)=\Delta\alpha/(4+\Delta\alpha)+4V_2/(4+\Delta\alpha)+\{\chi(V_1-V_2)\}/(4+\Delta\alpha) \quad (9)$$

$$Vout(\text{positive}, \alpha, 3, 4)=\{Vref(8+\Delta\alpha)\}/4-V_2-\{\chi(V_1-V_2)\}/4-(V_1\cdot\Delta\alpha)/4 \quad (10)$$

$$Vout(\text{negative}, \alpha, 3, 4)=-\{Vref\cdot\Delta\alpha)\}/4+V_2+\{\chi(V_1-V_2)\}/4-(V_1\cdot\Delta\alpha)/4 \quad (11)$$

where Vref is a first reference voltage supplied to the first reference voltage input terminal 200, $V_1$ is a second reference voltage supplied to the second reference voltage input terminal 201, and $V_2$ is a third reference voltage supplied to the third reference voltage input terminal 202.

Figure 6:
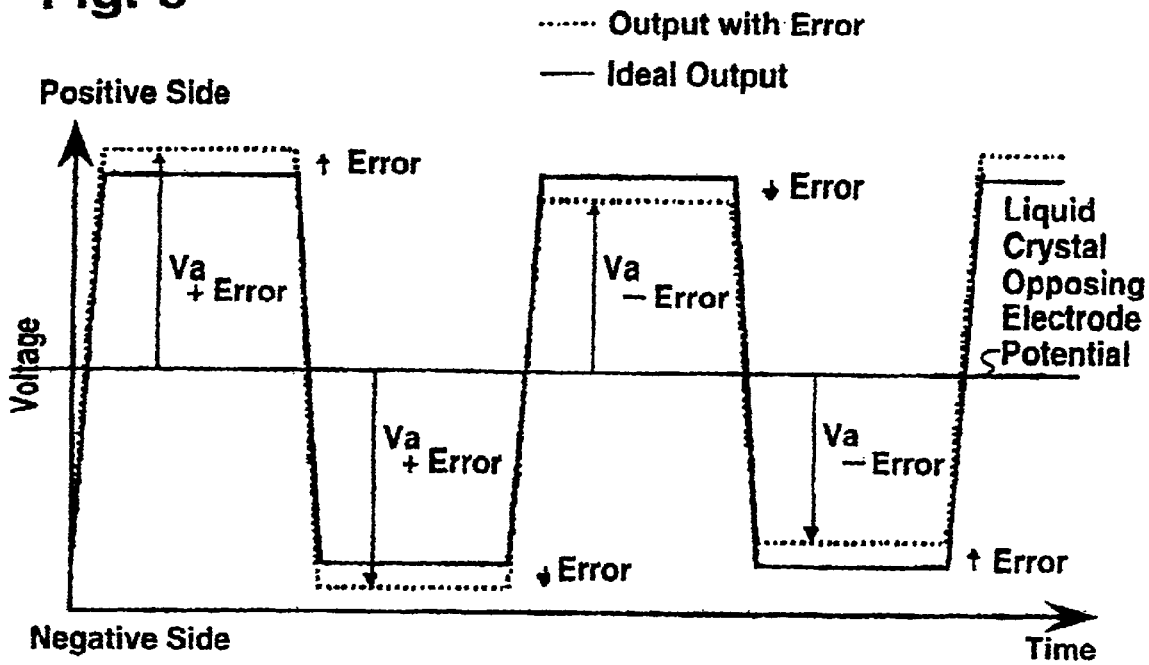
FIG. 6 is a waveform diagram showing an output signal when a liquid crystal is driven by the liquid crystal drive circuit shown in FIG. 2.
Figure 8:
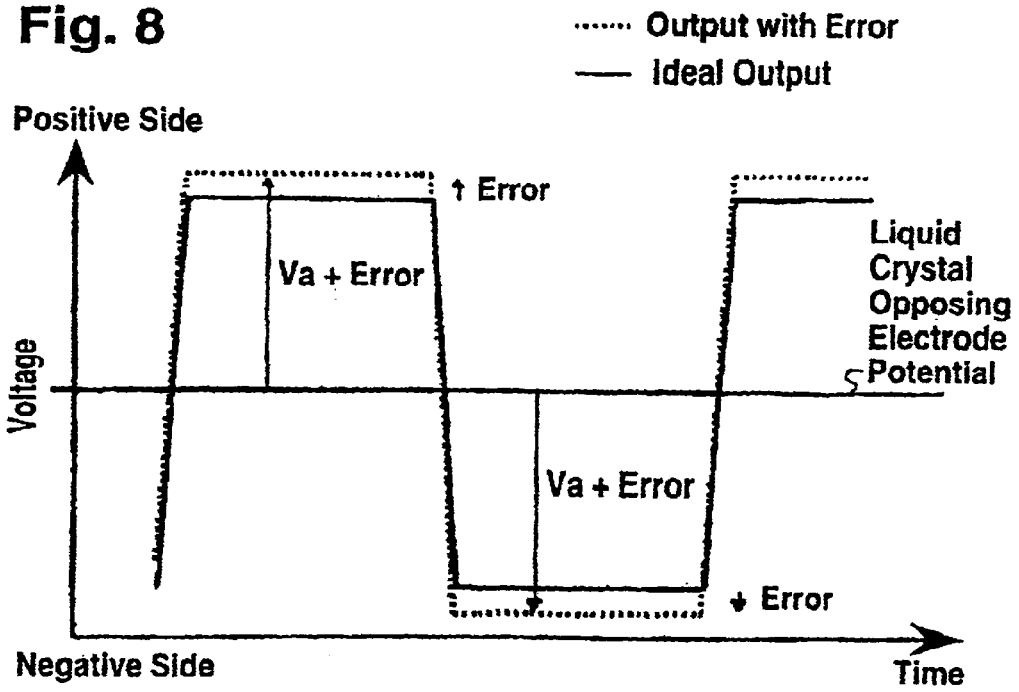
FIG. 8 is a waveform diagram showing an output signal when a liquid crystal is driven by the prior art liquid crystal drive circuit.
Figure 7:
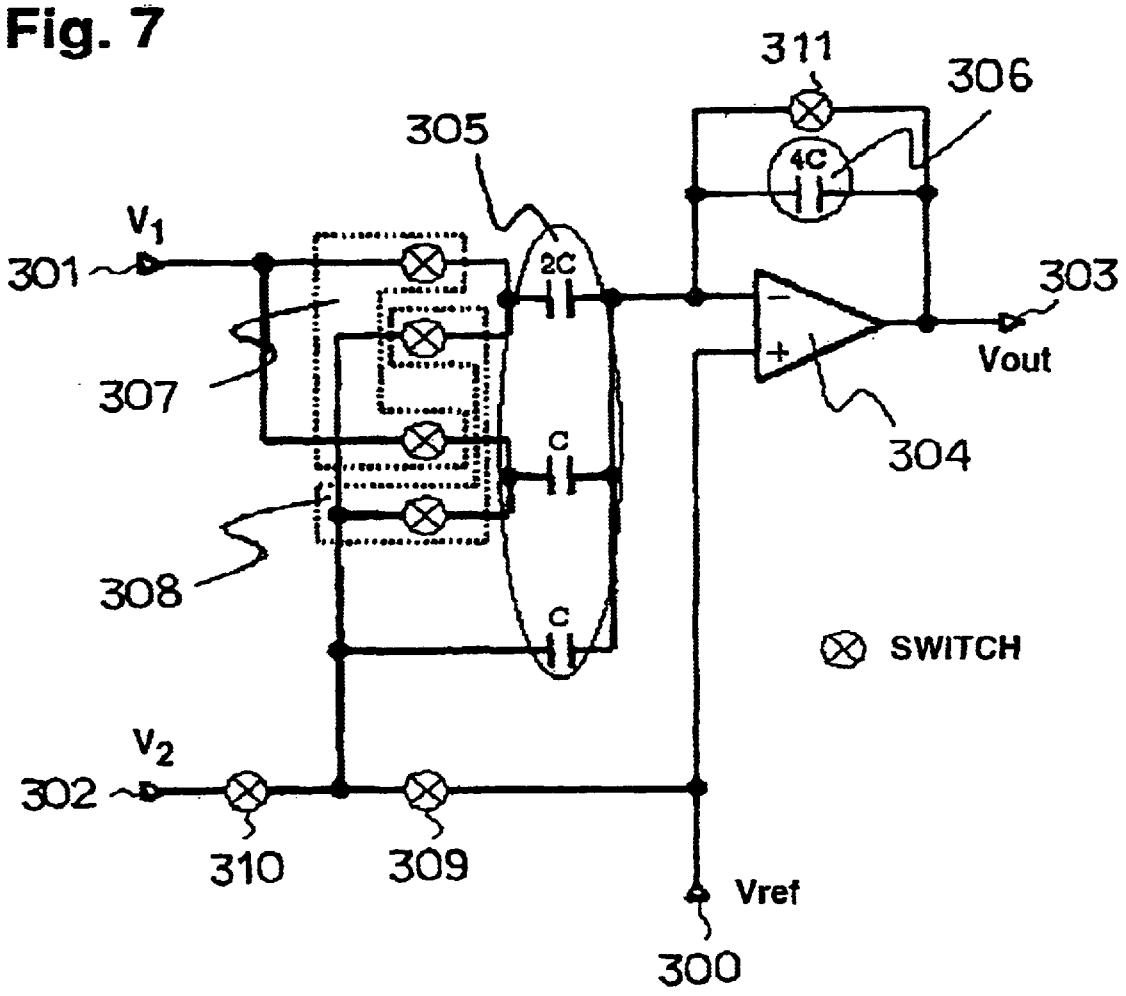
FIG. 7 is a circuit diagram of the prior art liquid crystal drive circuit.

In the case of driving the liquid crystal panel, the AC drive is carried out by sequentially outputting the voltages expressed by the equations (8) to (11). If the capacitance value difference expressed in the equations (8) to (11) occurs, the output signal becomes as shown in FIG. 6. Therefore, an actually displayed color, namely, an effective value is expressed by the equation (12):

$$\{Vout(\text{positive}, \alpha, 1, 2)-Vout(\text{negative}, \alpha, 1, 2)+Vout(\text{positive}, \alpha, 3, 4)-Vout(\text{negative}, \alpha, 3, 4)\}/4 \quad (12)$$

Here, this equation (12) can be modified as the equation (13), similarly to the equation (3) and the equation (6) as mentioned above:

$$\{A(\Delta\alpha)+B(\Delta\alpha)\}/2 \quad (13)$$

On the other hand, when the value of the second capacitor group 206 is deviated from the value of the first capacitor group 205 by a capacitance value $\Delta\beta$ in a capacitance increasing direction, the voltage value of a positive side and the voltage value of a negative side are expressed by the equations (14) to (17) for the first and second frames and the third and fourth frames, respectively:

$$Vout(\text{positive}, \beta, 1, 2)=\{Vref(8+\Delta\beta)\}/(4+\Delta\beta)-4V_2/(4+\Delta\beta)-\{\chi(V_1-V_2)\}/(4+\Delta\beta) \quad (14)$$

$$Vout(\text{negative}, \beta, 1, 2)=\Delta\beta/(4+\Delta\beta)+4V_2/(4+\Delta\beta)+\{\chi(V_1-V_2)\}/(4+\Delta\beta) \quad (15)$$

$$Vout(\text{positive}, \beta, 3, 4)=\{Vref(8+\Delta\beta)\}/4-V_2-\{\chi(V_1-V_2)\}/4-(V_1\cdot\Delta\beta)/4 \quad (16)$$

$$Vout(\text{negative}, \beta, 3, 4)=-\{Vref\cdot\Delta\beta)\}/4+V_2+\{\chi(V_1-V_2)\}/4-(V_1\cdot\Delta\beta)/4 \quad (17)$$

Therefore, an actually displayed color, namely, an effective value is expressed by the equation (18):

$$\{Vout(\text{positive}, \beta, 1, 2)-Vout(\text{negative}, \beta, 1, 2)+Vout(\text{positive}, \beta, 3, 4)-Vout(\text{negative}, \beta, 3, 4)\}/4 \quad (18)$$

Here, this equation (18) can be modified as the equation (19), similarly to the equation (13) as mentioned above:

$$\{A(\Delta\beta)+B(\Delta\beta)\}/2 \quad (19)$$

Accordingly, a output voltage difference $\Delta V'$, which is the degree of this color unevenness in the liquid crystal drive circuit of this embodiment, is expressed by the following equation (20):

$$\Delta V'=\{A(\Delta\alpha)+B(\Delta\alpha)\}/2-\{A(\Delta\beta)+B(\Delta\beta)\}/2=\Delta V/2-\{A(\Delta\beta)-B(\Delta\alpha)\}/2 \quad (20)$$

In this equation (20), approximation shown in the equations (21) and (22) is possible:

$$A(\Delta\beta)=A(\Delta\alpha)\times(4+\Delta\alpha)/(4+\Delta\beta)\cong A(\Delta\alpha) \quad (21)$$

$$B(\Delta\alpha)=B(\Delta\beta)+(V_1\cdot\Delta\beta)/4+(V_2\cdot\Delta\beta)/4-(Vref\cdot\Delta\beta)/4+(Vref\cdot\Delta\beta)/4\cong B(\Delta\beta) \quad (22)$$

Accordingly, the term $\{A(\Delta\beta)-B(\Delta\alpha)\}$ in the equation (20) becomes $\{\Delta V+\delta V\}$, where $\delta V<<\Delta V$.

Accordingly, the equation (20) can be modified as the equation (23):

$$\Delta V'=-\delta V/2 \quad (23)$$

Here, comparing the equation (23) with the equation (7), since $\Delta V'<<\Delta V$, the difference in the output voltage can be greatly reduced in comparison with the prior art. Namely, the color unevenness in the liquid crystal panel can be minimized to the utmost.

Considering a specific example in that the first reference voltage Vref=5V, the second reference voltage $V_1$=1V, the third reference voltage $V_2$=2V, $\chi$=3, $\Delta\alpha$=0.01 and $\Delta\beta$=0.02, the voltage difference in the prior art is $\Delta V$=30 mV, and the voltage difference in the present invention is $\Delta V'$=0.5 mV, which is evidently improved over the prior art.

In the above mentioned embodiment, the circuit construction outputting a single output signal has been described. It can be modified to a multi-output circuit having a plurality of drive circuits similar to the above mentioned drive circuit.

As mentioned above, when a gradation display is carried out by AC-driving a liquid crystal panel by use of a liquid crystal drive circuit constituted of a switched capacitor type D/A converter, there occurs an output error attributable to an error or a variation in capacitance value of a first capacitor group and a second capacitor group provided in the liquid crystal drive circuit, with the result that the output error becomes a cause for a color unevenness. Under this circumstance, according to the present invention, by replacing the connection of the first capacitor group and the connection of the second capacitor group by each other for example at every "n" frames by means of switch means, the polarity of the appearing output error is inverted at every "n" frames, with the result that the output error is canceled in units of "2n" frames, and therefore, the color unevenness can be advantageously eliminated when the liquid crystal panel is displayed.

What is claimed is:

1. A liquid crystal drive circuit for AC-driving a liquid crystal panel, the liquid crystal drive circuit including a switched capacitor type D/A converter having a sample period and a hold period, the liquid crystal drive circuit comprising:

a differential operational amplifier;

a first reference voltage connected to one input terminal of said differential operational amplifier;

a first capacitor group connected to the other input terminal of said differential operational amplifier for dividing second and third reference voltages;

a second capacitor group connected between an output terminal and the other input terminal of said differential operational amplifier; and switch means for changing a connection condition of said first capacitor group and said second capacitor group to said differential operational amplifier, said switch means being on-off controlled at every predetermined period for changing said connection condition, a plurality of liquid crystal drive circuits provided to realize a multi-output, and wherein said differential operational amplifier has a non-inverted input terminal connected to a first reference voltage input terminal, wherein said first capacitor group is constituted of a plurality of unitary capacitors as a basic element, which are connected to an inverted input terminal of said differential operational amplifier, said second capacitor group is constituted of a plurality of unitary capacitors as a basic element, which are connected to said inverted input terminal of said differential operational amplifier, and wherein said switch means comprises a "1A"th switch group having switches each having one end connected to a corresponding capacitor in said first capacitor group and the other end connected to a second reference voltage input terminal, a "2A"th switch group having switches each having one end connected to a corresponding capacitor in said first capacitor group, a "3A"th switch having one end connected to the other end of said "2A"th switch group and the other end connected to said inverted input terminal of said differential operational amplifier, a "4A"th switch having one end connected to the other end of said "2A" the switch group and the one end of said "3A"th switch and the other end connected to said output terminal of said differential operational amplifier, a "5A"th switch having one end connected to the other end of said "2A"th switch group, the one end of said "3A"th switch and the one end of said "4A"th switch and the other end connected to said first reference voltage input terminal and said non-inverted input terminal of said differential operational amplifier, and a "BA"th switch having one end connected to the other end of said "2A"th switch group and the respective one ends of said "3A"th to "5A"th switch and the other end connected to said third reference voltage input terminal, a "1B"th switch group having switches each having one end connected to a corresponding capacitor in said second capacitor group and the other end connected to said second reference voltage input terminal, a "2B"th switch group having switches each having one end connected to a corresponding capacitor in said second capacitor group, a "3B"th switch having one end connected to the other end of said "2B"th switch group and the other end connected to said inverted input terminal of said differential operational amplifier, a "4B"th switch having one end connected to the other end of said "2B"th switch group and said one end of said "3B"the switch and the other end connected to said output terminal of said differential operational amplifier, a"5B"th switch having one end connected to the other end of said "2B"th switch group, said one end of said "3B"th switch and said one end of said "4B"th switch and the other end connected to said first reference voltage input terminal and said non-inverted input terminal of said differential operational amplifier, and a "6B"th switch having one end connected to the other end of said "2B"th switch group and said respective one ends of said "3B"th to "5B"th switch and the other end connected to said third reference voltage input terminal.

2. A liquid crystal drive circuit claimed in claim 1, wherein said "4A"th switch and said "4B"th switch are on-off controlled in such a manner that during each of said predetermined periods, one of said "4A"th switch and said "4B"th switch is ON and the other of said "4A"th switch and said "4B"th switch is OFF, in order to alternately replace said first capacitor group and said second capacitor group by each other at every predetermined periods.

3. A liquid crystal drive circuit claimed in claim 1, wherein when said "4A"th switch is ON, said "4B"th switch is OFF, and said "1B"th switch group, said "3A"th switch and said "5B"th switch and said "6B"th switch are maintained in an OFF condition, and at the same time, said "2B"th switch group is maintained in an ON condition, and furthermore, said "1A"th switch group, said "2A"th switch group, said "5A"th switch, said "6A"th switch and said "3B"th switch are on-off switched in accordance with an input data, and wherein when said "4B"th switch is OFF, said "4A"th switch is ON, and said "1A"th switch group, said "3B"th switch and said "5A"th switch and said "6A"th switch are maintained in an OFF condition, and at the same time, said "2A"th switch group is maintained in an ON condition, and furthermore, said "1B"th switch group, said "2B"th switch group, said "5B"th switch, said "6B"th switch and said "3A"th switch are on-off switched in accordance with said input data.

4. A liquid crystal drive circuit claimed in claim 1 wherein said switch means being complementarily on-off controlled in units of "n" frames.

5. A liquid crystal drive circuit claimed in claim 1 wherein a plurality of liquid crystal drive circuits are provided to comply to realize a multi-output.

* * * * *